US007107722B2

(12) United States Patent
Casali et al.

(10) Patent No.: US 7,107,722 B2
(45) Date of Patent: Sep. 19, 2006

(54) OPERATOR ASSEMBLY

(75) Inventors: Celestino Casali, Nembro (IT); David Schuda, Wheaton, IL (US)

(73) Assignee: The ChamberLain Group, Inc., Elmhurst, IL (US)

( * ) Notice: Subject to any disclaimer, the term of this patent is extended or adjusted under 35 U.S.C. 154(b) by 101 days.

(21) Appl. No.: 09/992,543

(22) Filed: Nov. 5, 2001

(65) Prior Publication Data

US 2003/0084615 A1 May 8, 2003

(51) Int. Cl.
*E05F 11/24* (2006.01)

(52) U.S. Cl. ..... 49/341; 49/339; 49/340

(58) Field of Classification Search ..... 49/339, 49/340, 344, 356, 341, 343, 139, 140; 74/89, 74/38

See application file for complete search history.

(56) References Cited

U.S. PATENT DOCUMENTS 5,687,507 A * 11/1997 Beran ..... 49/340
6,223,469 B1 * 5/2001 Moll ..... 49/341
6,336,294 B1 * 1/2002 Kowalczyk et al. ..... 49/339

OTHER PUBLICATIONS

International Search Report, dated Mar. 19, 2003, in PCT application PCT/US02/34675.

* cited by examiner

*Primary Examiner*—Jerry Redman
(74) *Attorney, Agent, or Firm*—Fitch, Even, Tabin & Flannery

(57) ABSTRACT

An operator assembly for shifting a movable barrier between open and closed positions thereof, wherein the operator assembly can be configured to function with a variety of different barrier sizes and orientations. The operator assembly may include one or more interchangeable transmission components for adapting the operator for use with different gate sizes and installations. The operator assembly may also comprise a substantially linear drive train for permitting use with different barrier orientations.

22 Claims, 14 Drawing Sheets

22
20
40
30
32
70
154
50
74
76
152
72
90
64
78
60
66
68
62
12
14
150
94
10
1
2

OPERATOR ASSEMBLY

FIELD OF THE INVENTION

The invention relates generally to an operator assembly, and particularly to an operator assembly for shifting a movable barrier.

BACKGROUND OF THE INVENTION

Operator assemblies, such as gate operators, are typically used for opening and closing of movable barriers, such as gates for selectively permitting access to a driveway or a walkway. Gate operators may use a system of linkage arms to pivot a hinged gate about its hinges and move the gate between open and closed positions.

Gate operators typically have a motor with an output shaft offset from the linkage or operating arms connected to the gates. However, offsetting the motor may require two different models of gate operators to be made, one for operating gates hinged on their left sides and another for operating gates hinged on their right sides. Providing two different models of gate operators, each designed for a specific hinge orientation of the gate, is disadvantageous in that it may increase the complexity and cost of producing the two different gate operators. Furthermore, having gate operators configured for solely right or left hand hinged gates limits the versatility of the operators.

Gates may come in a variety of different sizes, and may range from smaller gates for walkways, larger gates for single width driveways, and even larger gates for dual width driveways. Different gate sizes may require different gate operators, with each gate operator having a gearing ratio designed exclusively for the specific size or range or sizes of the gates. For example, a larger gate may require more torque than a smaller gate and thus a lower gearing ratio. A larger gate may also require slower opening by the gate operator due to the longer length thereof, in order to maintain a speed for the end of the gate opposite the hinged end comparable to a smaller gate. Producing different gate operators each having a different gearing ratio configured specifically for a particular size or range of gate sizes is disadvantageous due to the multiple different gate operators required. Furthermore, the versatility of the gate operator having a specific gear ratio for a specific gate is limited to use with that gate.

The linkage or arm components of a gate operator may have different formations thereon. For example, in a screw-type gate operator a thread may be provided at one end of an arm for engagement with a threaded screw. The thread may be integrally formed on the arm, or the thread may be attached separately. Attaching a separate thread to the arm can be disadvantageous because the thread may separate from the arm during repeated use. Thus, it is desirable to provide an operator assembly having components securely held together.

Gate operators are typically configured to be electronically activated. For example, the gate operator may be wired to a control, or may receive radio or remote control signals for activation thereof. Occassionally, however, a user may wish to open the gate manually, i.e., without the operation of the motor. Manually opening of the gate can be disadvantageous because the motor may be coupled to the arm or linkage, and movement of the arm or linkage may harm the motor. In addition, the motor may restrict the ease at which the gate can be manually shifted. Thus, it is desirable to provide an operator that is adapted to permit either manual or automated operation.

SUMMARY OF THE INVENTION

In accordance with the invention, an operator assembly for shifting a movable barrier and a method of manufacture therefor is provided that allows the operator to be configured for a wide variety of different installations and uses.

The operator assembly may be configured for use with different sizes of movable barriers, such as gates, thereby permitting the operator to have increased versatility. For example, the operator assembly may be provided with an adjustable output adapted for a particular barrier size or range of barrier sizes. The adjustable output may comprise a transmission having one or more components selectively interchangeable by the manufacturer, user, installer, or other person or persons to allow the gate operator to readily be tailored for the particular barrier size or range of barrier sizes. Providing a standardized operator assembly with one or more interchangeable transmission components can increase the versatility of the operator assembly and reduce manufacturing costs.

The operator assembly may also be configured for use with different installation configurations, thereby simplifying the set-up and use of the operator with different barrier orientations. For example, the operator assembly may be configured to be used with both barriers hinged at a right side and barriers hinged at a left side. The operator assembly may also be used with different mounting configurations, such as different pivotal mounting locations on the barrier, further increasing the versatility of the operator assembly. The operator assembly may include a substantially linear drive train or transmission, thereby eliminating the need to provide separate gate operators for left hinged barriers and right hinged barriers. Such a versatile operator assembly can simplify installation and manufacturing thereof.

The operator assembly may include a motor having a predetermined power rating and an actuator driven by the motor for shifting the movable barrier. The motor may drive the actuator with a predetermined output force that is adjustable. According to an aspect of the invention, the predetermined power rating of the motor may comprise a predetermined maximum output torque generated by the motor independently of the predetermined output force selected for the actuator.

In an aspect of the invention, the adjustable transmission may include a pair of gears cooperating to define a gear ratio therebetween. To select the predetermined output force for the actuator, one or more of the gears may be replaceable with another gear to change the gear ratio. In a further aspect of the invention, both of the gears may be replaceable with another pair of gears having a different gear ratio therebetween in order to configure the output force of the actuator for use with various arrangements of movable barriers. In yet another aspect of the invention, both of the gears may be replaceable with another pair of gears having a different gear ratio therebetween in order to configure the output force of the actuator for use with various sizes of movable barriers.

In another aspect of the invention, the replaceable gears may provide the operator assembly with versatility as far as mounting configurations. Different gear sets may be provided to allow for the gate operator assembly to be connected relative to the movable barrier at different locations thereon. For example, connecting the operator assembly to the movable barrier at a location farther from a hinge of the barrier may provide a mechanical advantage, thereby reducing the torque required for shifting the barrier and allowing a transmission having a higher gear ratio to be used. Conversely, connecting the operator assembly to the movable barrier at a location closer to the hinge of the barrier may require an increased torque for shifting the barrier, with the increased torque provided by a transmission having a lower gear ratio. Thus, providing the gate operator with interchangeable transmission components allows the gate operator to be adapted for connection at different locations on the movable barrier.

In an aspect of the invention, the motor may include a housing or casing pivotably connectable relative to the movable barrier, such as to a fixed mount. The actuator may also be pivotably connectable relative to the movable barrier.

In an aspect of the invention, the actuator may comprise a hollow tubular member or arm having a pivot connection at an end thereof. The pivot connection may comprise a flattened region having an aperture therethrough integrally formed with the tubular member. A pin may be provided through the aperture for pivotably connecting the arm relative to the movable barrier, such as with a yoke mounted relative to the movable barrier. The flatted region may be provided by flattening or crimping the end of the hollow tubular member. The tubular member or arm may also be stamped. The aperture may then be drilled therethrough. The aperture may also be provided through the tubular member prior to flattening thereof. In an aspect of the invention, the actuator arm may have a bend or other departure from its longitudinal axis effective to offset the aperture or pivot point from the longitudinal axis of the arm, such as to provide a mechanical advantage.

According to an aspect of the invention, the motor may have an output shaft aligned with a drive shaft of the actuator to maximize the different barrier configurations that the operator assembly can be used with. The output shaft of the motor may be, but is not necessarily, coaxially aligned with the drive shaft of the actuator.

According to a further aspect of the invention, the transmission may comprise a pair of intermediate shafts provided between the drive shaft of the actuator and the motor output shaft. The intermediate shafts may be positioned normally relative to the drive and motor output shafts. Gears may be provided on the shafts for transmitting rotation from the motor output shaft to the drive shaft. As discussed above, a pair of gears may be provided having a gearing ratio therebetween for controlling the predetermined output force provided by the actuator. One of the pair of gears or both of the pair of gears may be interchangeable with another gear or another pair of gears to provide a different gear ratio and thus change the predetermined output force provided by the actuator.

In accordance with the invention, the operator assembly may be provided with a screw-type drive for selectively shifting the movable barrier. The actuator may comprise an arm extending between the operator assembly and the barrier. The end of the arm proximate the movable barrier may be pivotably connected relative thereto.

The drive shaft may comprises a threaded screw coaxially aligned with the arm, the threaded screw having a threaded region adapted for engagement with an internal thread or nut provided on the second end of the arm. The threaded screw may be arranged for rotation by the transmission, such that rotation of the motor output shaft will cause rotation of the threaded screw. Rotation of the threaded screw may then cause the nut and thus the arm to be advanced or retracted relative thereto, depending upon the direction of rotation of the motor output shaft.

According to an aspect of the invention, the internal thread or nut may comprise a molded plastic or polymer material. The nut may be molded onto the end of the actuator arm, such as by using insert molding techniques. The actuator may comprise a hollow member, such as a hollow tube or cylinder, having a wall with an inside surface and an outside surface. One or more apertures may be formed through the wall. The nut may include a portion on the outside surface and a portion on the inside surface of the wall, with material mechanically connecting the inside and outside nut portions extending through the aperture in order to secure the nut relative to the actuator arm.

In an aspect of the invention, the drive shaft and the actuator arm may be disposed within a housing. The housing may be fixed relative to the motor, and may comprises a hollow tubular member, such as a sleeve or tube. The coaxially aligned drive shaft and actuator arm may also be coaxially aligned with the housing.

A guide element may be provided on an end of the housing opposite from an end proximate the motor. The guide element may assist in maintaining the coaxial alignment with the actuator arm. In addition, the guide element may function a wiper, sliding against and/or cleaning an outer surface of the actuator arm as it moves therepast. Furthermore, the guide element may be configured to limit the outward extension of the actuator arm relative to the housing or sleeve member. The guide element may also function as a seal, preventing dirt, debris, or liquid from entering the inside of the housing or sleeve, such as to prevent contamination of lubrication between the sleeve and the actuator arm.

According to another aspect of the invention, the guide element may comprise a molded plastic or polymer material. The guide element may be molded onto the end of the housing or sleeve member, such as by using insert molding techniques. Similar to the actuator arm, the sleeve may comprise a hollow member, such as a hollow tube or cylinder, having a wall with an inside surface and an outside surface. One or more apertures may be formed through the wall. The guide element may include a portion on the outside surface and a portion on the inside surface of the wall, with material mechanically connecting the inside and outside guide element portions extending through the aperture in order to secure the guide element relative to the sleeve.

According to an aspect of the invention, the movable barrier may comprise a gate. The gate may be hinged at its left side or its right side. The motor of the operator assembly may have its output shaft generally aligned with the actuator arm thereof, thus permitting a single operator assembly to be used with both gates hinged at their left sides or gates hinged at their right sides.

According to another aspect of the invention, the operator assembly may be provided with a transmission having one or more interchangable gear sets positioned between the motor output shaft and the arm. A plurality of different gearing sets, each gearing set having a different gearing ratio, may be configured to be used with a single gate operator. Interchangeable gear sets allow a single gate operator to be readily adapted for use with different size gates. The gear sets may be provided to the end user, such as the installer or owner of the gate. Alternatively, the user may comprise the manufacturer, which may select a gear set for the operator assembly having the desired gear ratio and then provide the operator to the end user or installer.

In an embodiment of the invention, the operator assembly may include a transmission configured for selectively transmitting the motor output to the drive shaft or threaded screw. The transmission may have a configuration wherein the motor output is transmitted to the drive shaft and another configuration wherein the motor output is not transmitted to the drive shaft, thereby allowing the gate or movable barrier to be shifted without affecting the motor output. The transmission may include a cam mechanism selectively operable by a user for engaging or disengaging the transmission. When the transmission is disengaged, the user can manually shift the gate without harming the motor or without having to go against the output of the motor.

DETAILED DESCRIPTION

The invention is preferably embodied in an operator assembly 1, and a method of manufacturing the operator assembly 1, capable of being configured to shift movable barriers of various sizes and orientations.

Figures 1, 2, 3:
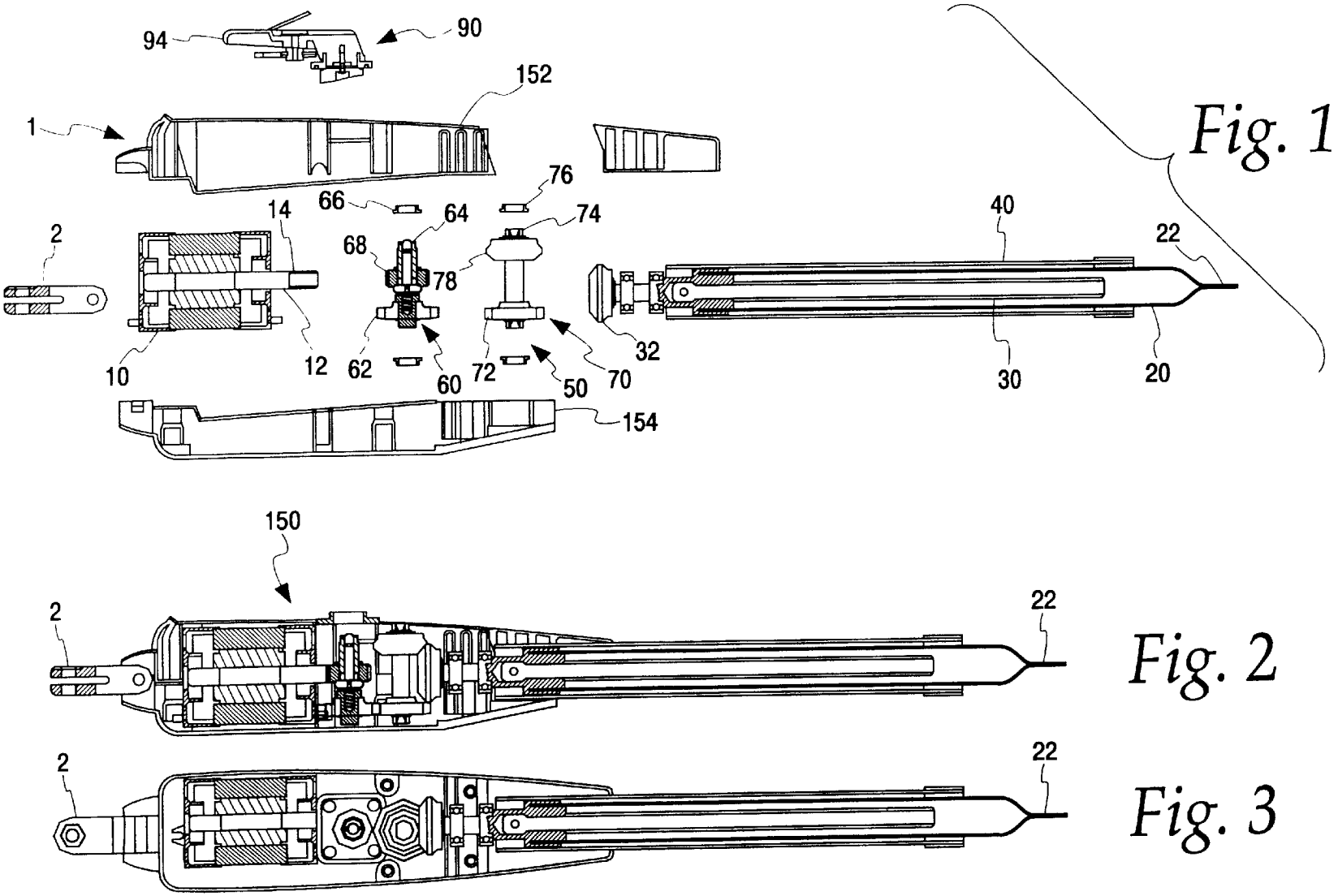
FIG. 1 is an exploded top plan view of an operator assembly according to an embodiment of the invention.
FIG. 2 is a top plan view of the assembled operator assembly of FIG. 1.
FIG. 3 is a side elevation view of the assembled operator assembly of FIG. 1.

FIGS. 1–26 illustrate an operator assembly 1 in accordance with aspects of the invention. The operator assembly 1 generally comprises a motor 10 adapted for rotating a driving shaft 30, as illustrated in FIG. 1, wherein rotation of the driving shaft 30 causes the extension or retraction of an actuator arm 20 relative to the driving shaft 30 with a predetermined output force. A movable barrier, such as a gate, is pivotably connectable relative to the actuator arm 20 and is selectively movable with the predetermined output force thereof.

A transmission 50 is provided between an output shaft 12 of the motor 10 and the driving member 30 that allows the predetermined output force provided by the actuator arm 20 to be selectively adjustable in order to allow configuration and tailoring of the operator assembly 1 with a variety of different barrier or gate sizes. The transmission 50 includes a pair of interchangeable gears, the pair of gears 62 and 72 cooperating to provide a gearing ratio for adjusting the output force relative to the rotation of the motor output shaft 12.

The interchangeable transmission components allow the operator assembly 1 to be configured according to the size of the movable barrier which it is to be used with, while still maintaining the use of the motor 10 with a predetermined power rating. For example, a larger barrier may have an increased size compared to a smaller barrier and thus require an output force having a greater torque. A larger barrier may have a greater length, and it may be desirable to configure the transmission of the operator assembly 1 to move the barrier at a slower speed as compared to the speed of moving a smaller barrier. For instance, an operator 1 not configured for use with a larger barrier may move the distal end of the barrier, opposite the hinged end thereof, at a faster rate than is desirable. For such a barrier a transmission 50 may be provided in the operator assembly 1 configured for use with such a larger barrier. The interchangeable transmission components may be installed during manufacture of the operator assembly 1, or may be provided with the operator 1 for installation by the end user or installer.

The selectively adjustable transmission 50 of the operator apparatus of the invention allows the same type of motor 10 to be used for different gate sizes. For example, a four pole motor may be used for both small and large gate sizes, when coupled with a transmission 50 having an appropriate gear ratio. A six pole or other type of motor may also be used with the operator apparatus of the invention.

As illustrated in FIG. 1, the transmission comprises two separate gear assemblies 60 and 70, each comprising a freely rotatable shaft 64 or 74 arranged substantially normal relative to the output shaft 12 of the motor 10. The shafts 64 and 74 may have ends rotatable within bushings or other friction and/or wear reducing elements 66 and 76. Each shaft 64 or 74 has two gears 62 and 68 or 72 and 78 mounted thereon.

The first shaft 64 has gear 68 adapted to be driven by a gear 14 provided on the motor output shaft 12. Rotation of the gear 68 causes rotation of the first shaft 64, which in turn causes rotation of the gear 62. The gear 62 is positioned for driving engagement with gear 72, mounted on the second shaft 74. Rotation of the gear 72 by the gear 62 causes rotation of the second shaft 74 and thus rotation of the gear 78 mounted thereto. The gear 78 is positioned for driving engagement with a gear 32 connected relative to an end of the driving shaft 30. Thus, the transmission 50 provides for the rotation of the driving shaft via rotation of the motor output shaft 12.

Figure 14:
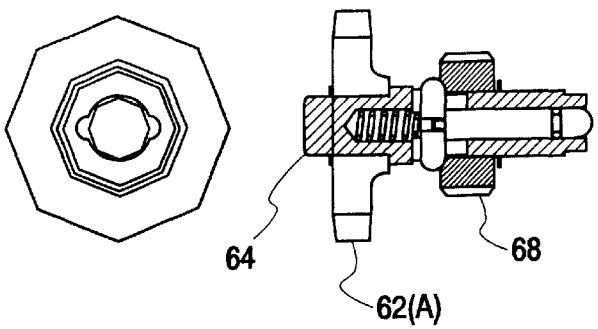
FIG. 14 is a section view of a gear set for use with the gear set of FIG. 13 according to the first embodiment of the invention.
Figure 13:
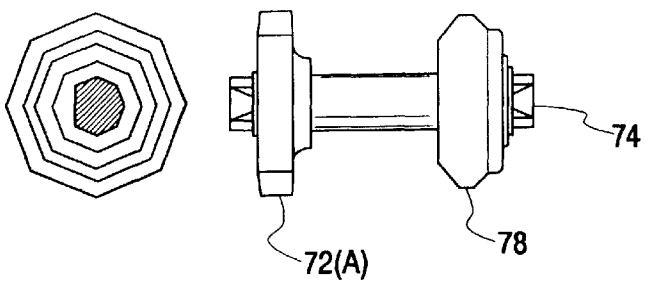
FIG. 13 is a side elevation view of a gear set for the operator assembly of FIG. 1 according to a first embodiment of the invention.
Figure 15:
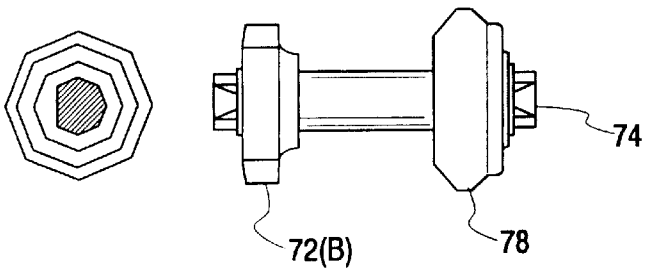
FIG. 15 is a side elevation view of a gear set for the operator assembly of FIG. 1 according to a second embodiment of the invention.
Figure 16:
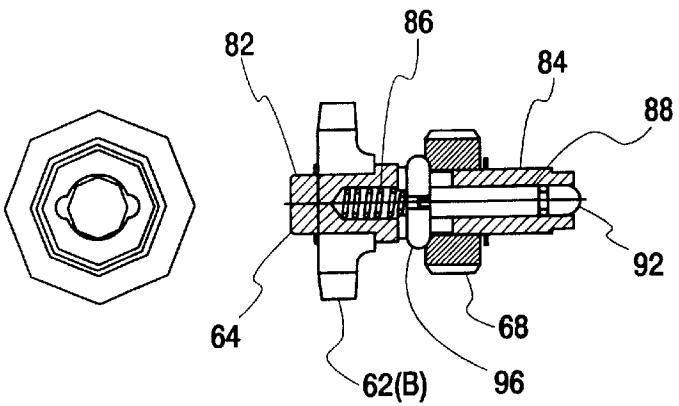
FIG. 16 is a section view of a gear set for use with the gear set of FIG. 15 according to the second embodiment of the invention.

The predetermined output force of the actuator arm 20 is determined by the transmission 50. In particular, the output force is determined by the gear ratio of the transmission 50 which is determined, in part, by the ratio between the gear 62 and gear 72. The gear 62 and the gear 72 are adapted to be readily interchangeable with different gears having a different gear ratio therebetween, thereby allowing the selective adjustment of the predetermined output force of the actuator arm 20. For example, a first set of gears 62(*a*) and 72(*a*), as illustrated in FIGS. 13 and 14, may have a 1:1 gear ratio therebetween. Such a 1:1 gear ratio may be suitable for use in a gate operator 1 configured for use with a small sized movable barrier. A second set of gears 62(*b*) and 72(*b*), as illustrated in FIGS. 15 and 16, may have a 3:2 gear ratio therebetween for stepping down the rotational output of the motor 10. A 3:2 gear ratio may be useful for larger sized movable barriers, where an increased torque and slower barrier shifting is desired. The gears 62 and 72 may comprise idler gears, and the gears 14, 32, 68, and 78 may comprise worm-type gears, or other such gears adapted for transmitting rotational forces in perpendicular arrangments.

The transmission 50 of the gate operator 1 is configured to be selective engaged and disengaged from the motor output shaft 12, allowing for the shifting of the movable barrier without operation of the motor output shaft 12. For example, the transmission 50 may be disengaged to permit the manual shifting of the movable barrier without causing the rotation of the motor output shaft, thereby reducing potential harm to the motor 10.

As illustrated in FIGS. 14 and 16, the first shaft 64 comprises two independently rotatable shafts 82 and 84. The shaft 82 has the gear 62 mounted thereon, and the shaft 84 has the gear 68 mounted thereon. A spring 86 is provided between the shafts 82 and 84 and biases the shafts 82 and 84 apart. When the shafts 82 and 84 are biased apart, they are allowed to rotate independently of each other. Thus, when biased apart, the rotation of the gear 68, such as by manually shifting of the movable barrier, will not cause the rotation of the gear 62 and resulting rotation of the gear 14 on the motor output shaft 12.

Operation of a camming mechanism 90, illustrated in FIG. 1, can provide a force overcoming the biasing force of the spring 86 to bias the shafts 82 and 84 together so that the two shafts 82 and 84 rotate dependently upon each other, i.e., rotation of gear 68 will cause rotation of gear 62, and vice versa. The camming mechanism 90 comprises a pin 92 extending through a bore 88 formed in shaft 84. The pin 92 is selective slidable within the bore 88 relative to the shaft 84 upon operation of a camming lever mechanism 94. Movement of the pin 92 against the biasing force of the spring 86 pushes coupling element 96 against the shaft 82 for coupling the shafts 82 and 84 together for dependent rotation. Conversely, release of the pin 92 with the camming lever mechanism 94 allow for the spring 86 to bias the coupling element 96 away from the shaft 82, thereby decoupling the shafts 82 and 84 to allow independent rotation thereof.

According to another aspect of the gate operator 1 of the invention, the driving shaft 30 and the motor output shaft 12 are substantially coaxial. The driving shaft 30 is also substantially coaxially aligned with the actuator arm 20. The coaxial arrangements allow for the gate operator 1 to be used with a variety of different configurations of movable barriers, and allow for versatility in the installation of the operator assembly 1. For instance, the coaxial arrangements provide a gate operator 1 that can be used with both left hinged gates and right hinged gates.

As discussed hereinabove, rotation of the driving shaft 30 causes the extension or retraction of the actuator arm 20 relative to the driving shaft 30 with a predetermined output force. When the operator assembly 1 is pivotably connected at one end to a mount fixed independently relative to the movable barrier and at another end pivotably connected relative to the movable barrier, the extension or retraction of the actuator arm 20 causes the shifting of the movable barrier.

In an aspect of the invention, a pivot connection 2 is provided at an end of the operator assembly. A pivot connection 22 is also provided at an end of the actuator arm 20 opposite the other pivot connection 2, as illustrated in FIGS. 1–3. The pivot connection 2 is fixable relative to a mount independent of the movable barrier while the other pivot connection 22 is fixable relative to the movable barrier. These pivot positions may also be reversed. The pivot connection 22 may be offset from the longitudinal axis of the arm 20, such as by forming a bend or elbow in the arm 20, to provide a mechanical advantage or to provide for a variety of different installation configurations for the operator assembly 1.

Figure 7:
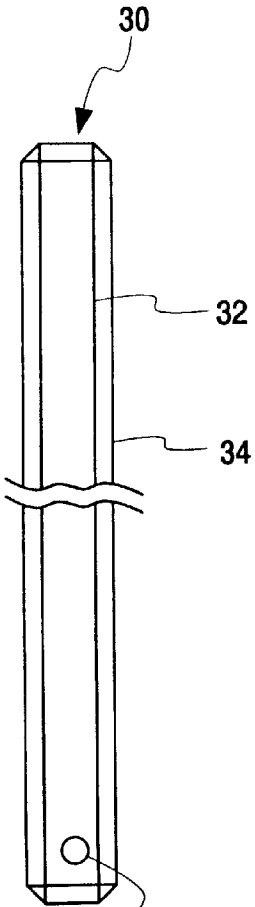
FIG. 7 is a side elevation view of a driving shaft of the operator assembly of FIG. 1.
Figure 11:
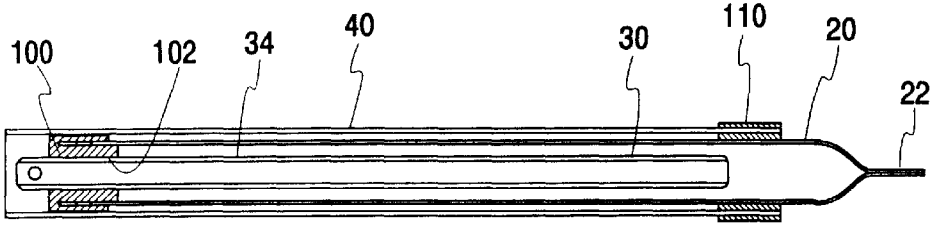
FIG. 11 is a side elevation view of the arm, sleeve and screw with the arm in a retracted position.
Figure 12:
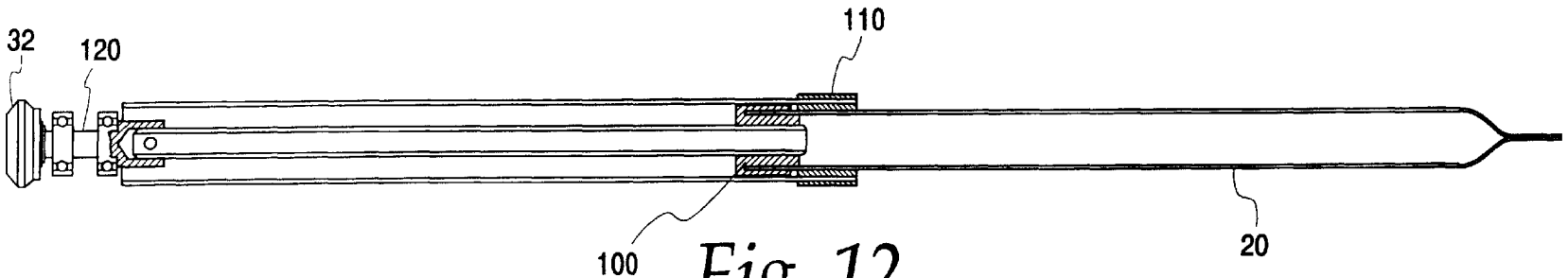
FIG. 12 is a side elevation view of the arm, sleeve and screw of FIG. 11 with the arm in an extended position.

The driving shaft 30 comprises a shaft 32 having external threads 34 thereon, as illustrated in FIG. 7. A threaded member or nut 100 is provided on the opposite end of the actuator arm 20 from the pivot connection 22. The external threads 34 of the driving shaft 30 cooperate with internal threads 102 formed on the nut 100 to extend or retract the actuator arm 20 relative to the driving shaft 30. Both the driving shaft 30 and the actuator arm 20 are housed within a hollow housing or sleeve 40, as illustrated in FIGS. 1, 11, and 12. In its retracted state the actuator arm 20 is substantially received within the housing 40, and the nut 100 is in threaded engagement with the shaft 30 and located proximate the motor 10, as illustrated in FIG. 11. As the driving shaft 30 rotates, the external threads 34 thereon, in combination with the pivot connection 22 being fixed relative to the driving shaft 30, cause the outward extension of the arm 20 relative to the housing 40 to an extended position, as illustrated in FIG. 12. An aperture 36 in the drive shaft 30 allows for the coupling of a shaft 22 thereto. The gear 32, discussed hereinabove, is mounted to the shaft 120 for rotating the driving shaft 30, as illustrated in FIG. 12.

As illustrated in FIGS. 11 and 12, a guide element 110 is provided at an end of the housing 40 opposite the motor 10. The guide element 110 functions to maintain the arm 20 and the housing 40 in coaxial alignment. The guide element or member 110 also functions as a seal, restricting the entry of dirt or other debris between the housing 40 and the arm 20.

In addition, the guide element 110 functions to limit the outward extension of the arm 20 relative to the housing 40 by engagement with the nut 100 on the end of the arm 20, as illustrated in FIG. 12. The guide element 110 also functions as a slide or wiper, sliding against and/or cleaning the arm 20 as it moves therepast.

Figure 10:
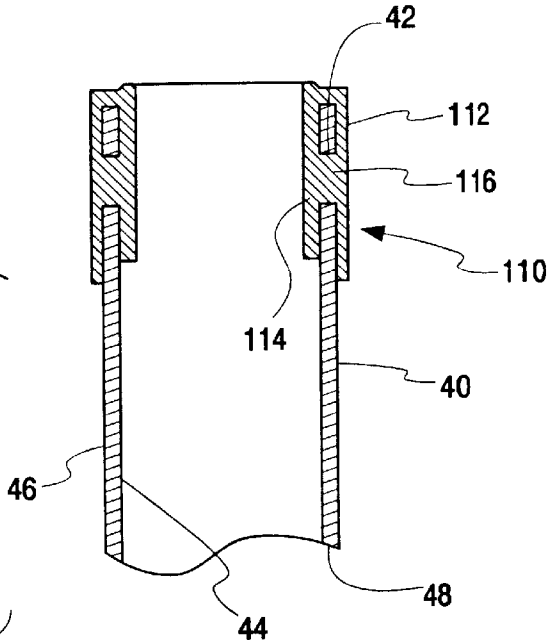
FIG. 10 is a section view of the sleeve of FIG. 8 after formation of the guide element.

The guide element 110 is attached in-situ to the end of the housing 40, as illustrated in detail in FIG. 10. The guide element 110 comprises a molded plastic or polymer material. An outer portion 112 of the guide element 110 surrounds an exterior surface 46 of a wall 48 of the tubular housing 40 and an inner portion 114 of the guide element 110 surrounds an interior surface 44 of the housing 40. A pair of apertures 42 are provided in the wall 48 of the housing 40, allowing portions 116 of the guide element 110 to mechanically connect the inner and outer portions 114 and 112 thereof, thereby securing the guide element 110 relative to the housing 40. In a method according to an aspect of the invention, the guide element 110 may be molded, such as by insert molding techniques, to the end of the housing 40. During the molding, the joining portions 116 of the guide element 110 are formed between the inner and outer portions 112 and 114 thereof.

Figure 17:
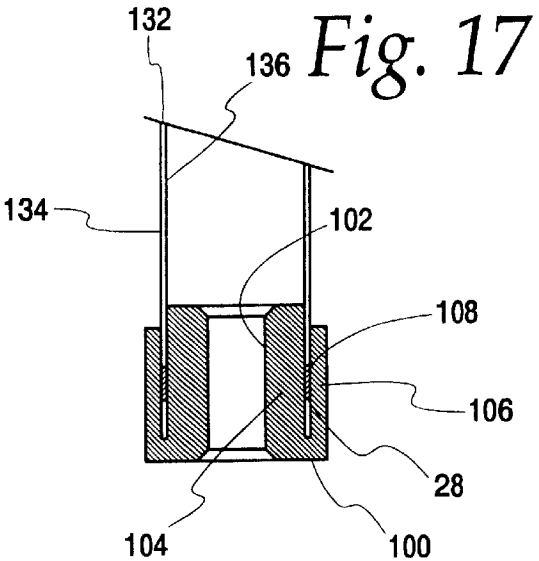
FIG. 17 is a section view of the threaded region of FIG. 6.

Similar to the construction of the guide element 110 and the joining thereof to the housing 40, the nut 100, discussed above, includes an inner portion 104 and an outer portion 106 joined via portions 108 extending through a pair of apertures 28 in the arm 20, as illustrated in FIG. 17. The inner portion 104 of the nut 100, which includes the internal threaded region 102, surrounds an interior surface 136 of a wall 132 of the tubular arm 20. The exterior portion 106 of the nut 100 surrounds an exterior surface 134 of the wall 132 of the arm 20. As with the guide element 110, the nut 100 is molded, such by using insert molding techniques, in-situ to the end of the arm 20. The portions 108 of the nut 100 provide a secure mechanical connection of the nut 100 relative to the arm 20.

Figure 9:
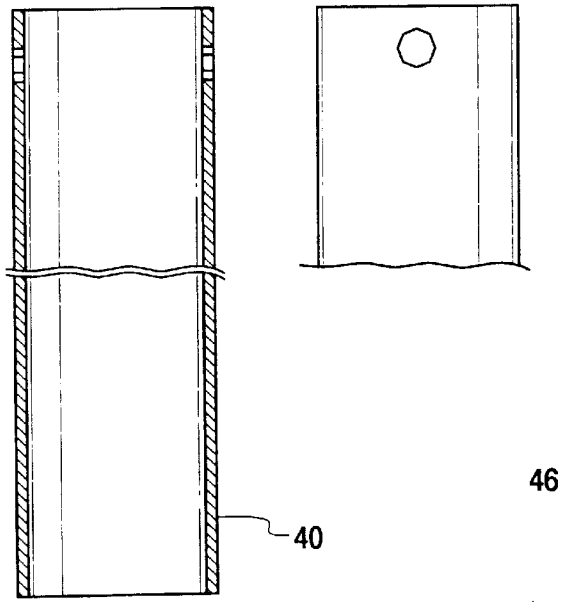
FIG. 9 is a side elevation view of a top portion of a sleeve prior to formation of the guide element and section view of a sleeve.
Figure 8:
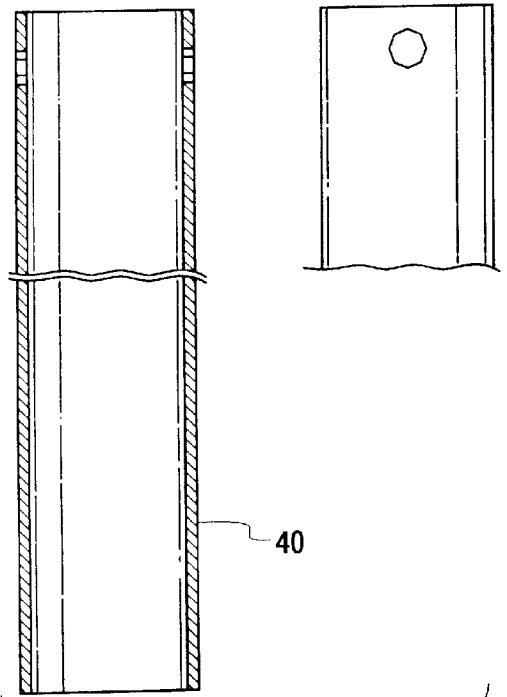
FIG. 8 is a section view of a sleeve of FIG. 1 prior to formation of a guide element.

Different lengths of arms 20 and housings 40 may be used to vary the amount of extension of the arm 20. For example, a shorter housing 40, such as illustrated in FIG. 8, may be used. A longer housing 40, such as illustrated in FIG. 9, may also be used.

Figure 6:
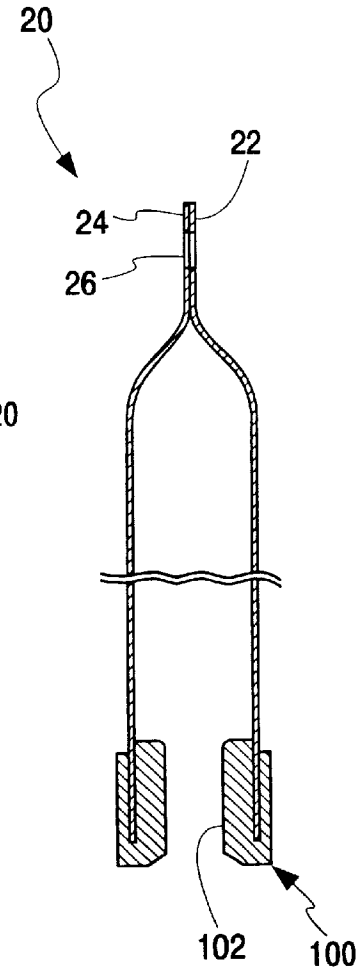
FIG. 6 is a section view of the arm of FIG. 5 taken along line 6—6 showing after formation of the threaded region and the pivot region.
Figure 5:
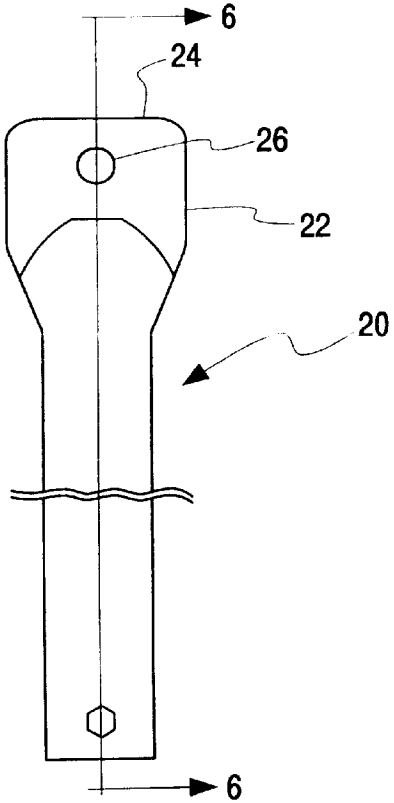
FIG. 5 is a front elevation view of the arm of FIG. 4 after formation of the pivot region and prior to formation of the threaded region.
Figure 4:
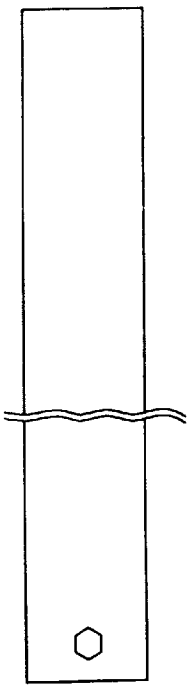
FIG. 4 is a front elevation view of an arm of the operator assembly of FIG. 1 prior to formation of a threaded region and a pivot region.
Figure 18:
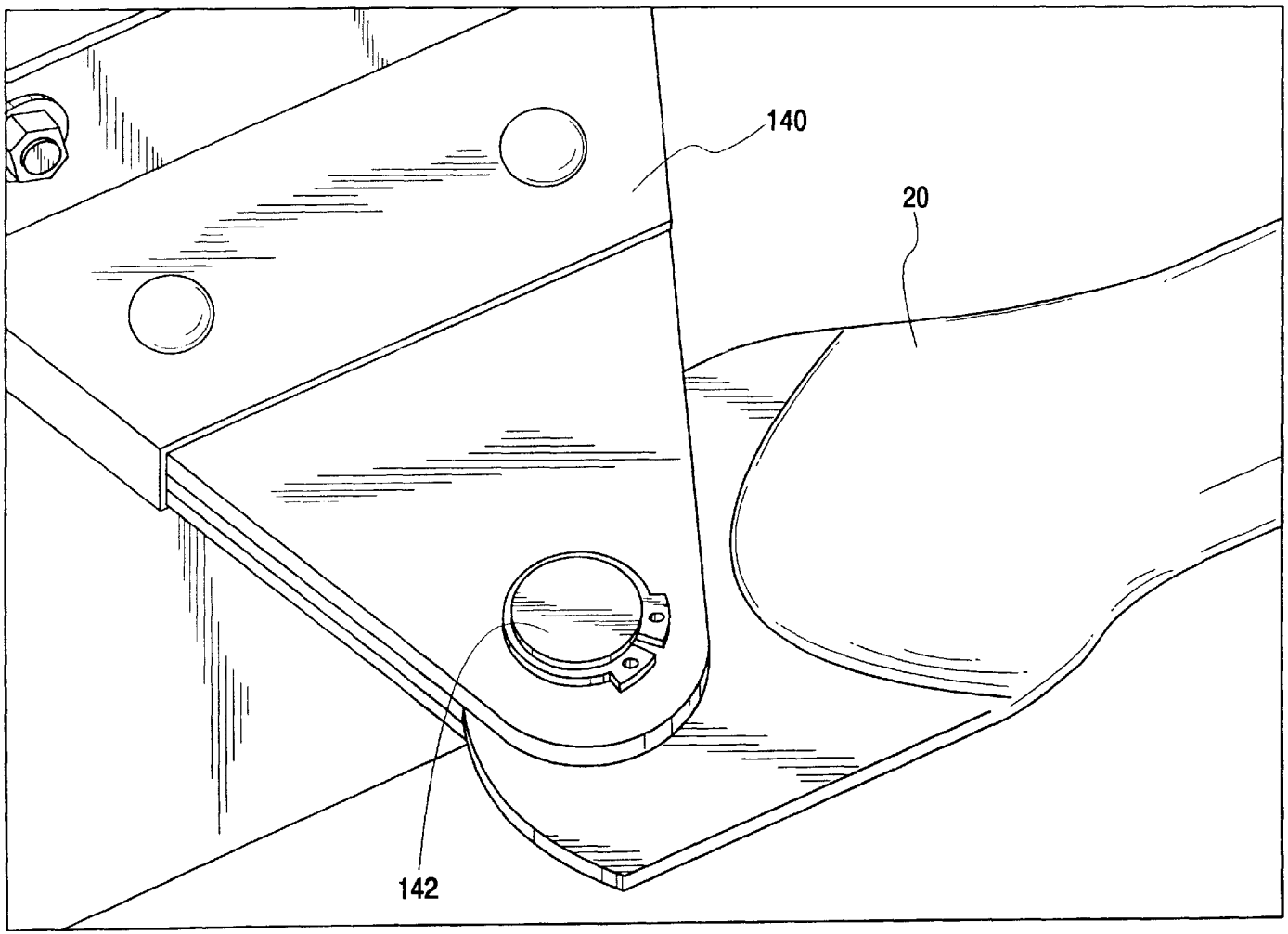
FIG. 18 is a perspective view of the pivot region of the arm pivotably attached with a pin to a yoke mounted relative to a barrier.
Figure 19:
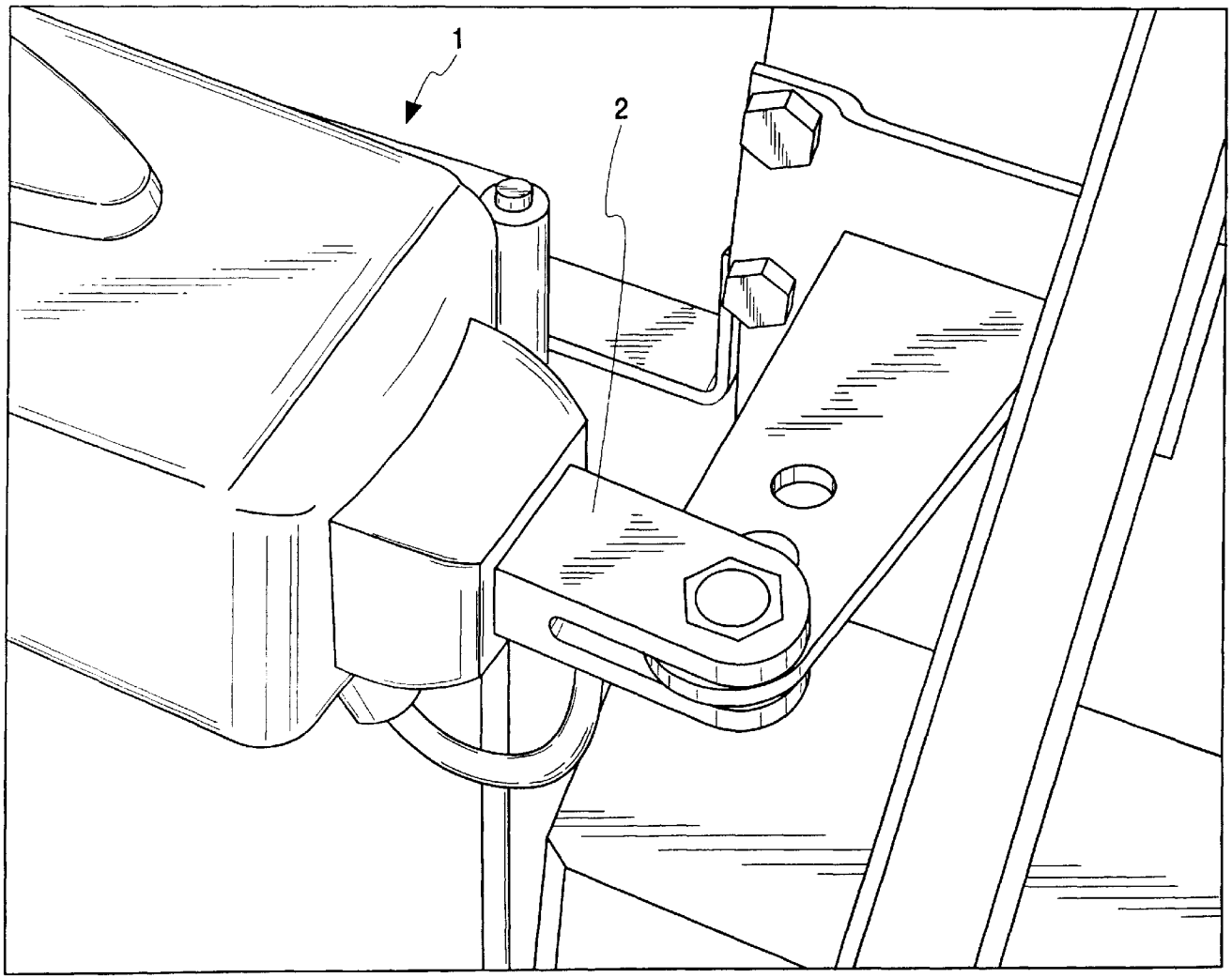
FIG. 19 is a perspective view of the pivot connection of the operator assembly of FIG. 1 pivotably attached to a fixed mount.
Figure 20:
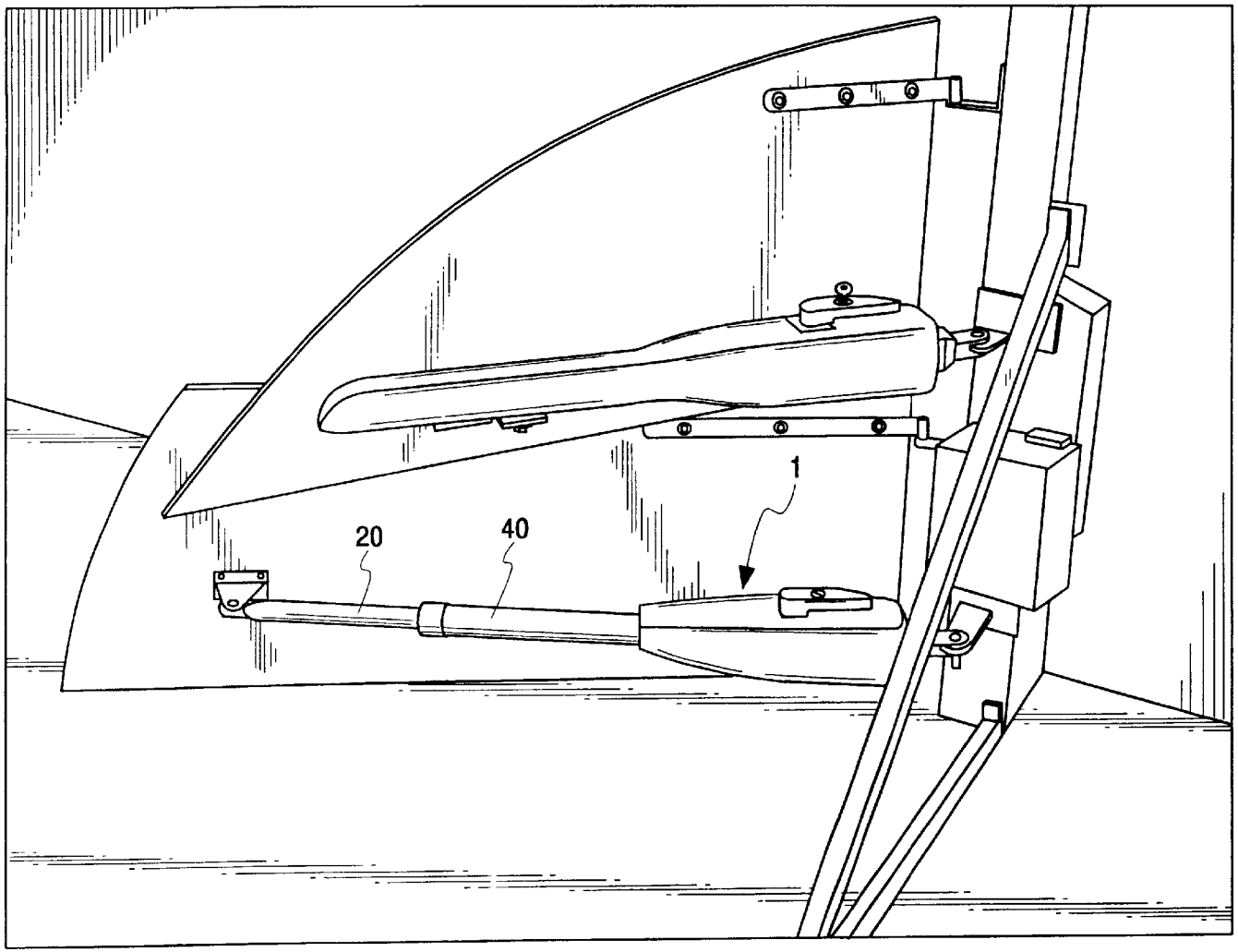
FIG. 20 is a perspective view of the operator assembly of FIG. 1 showing the arm in an extended position.
Figure 21:
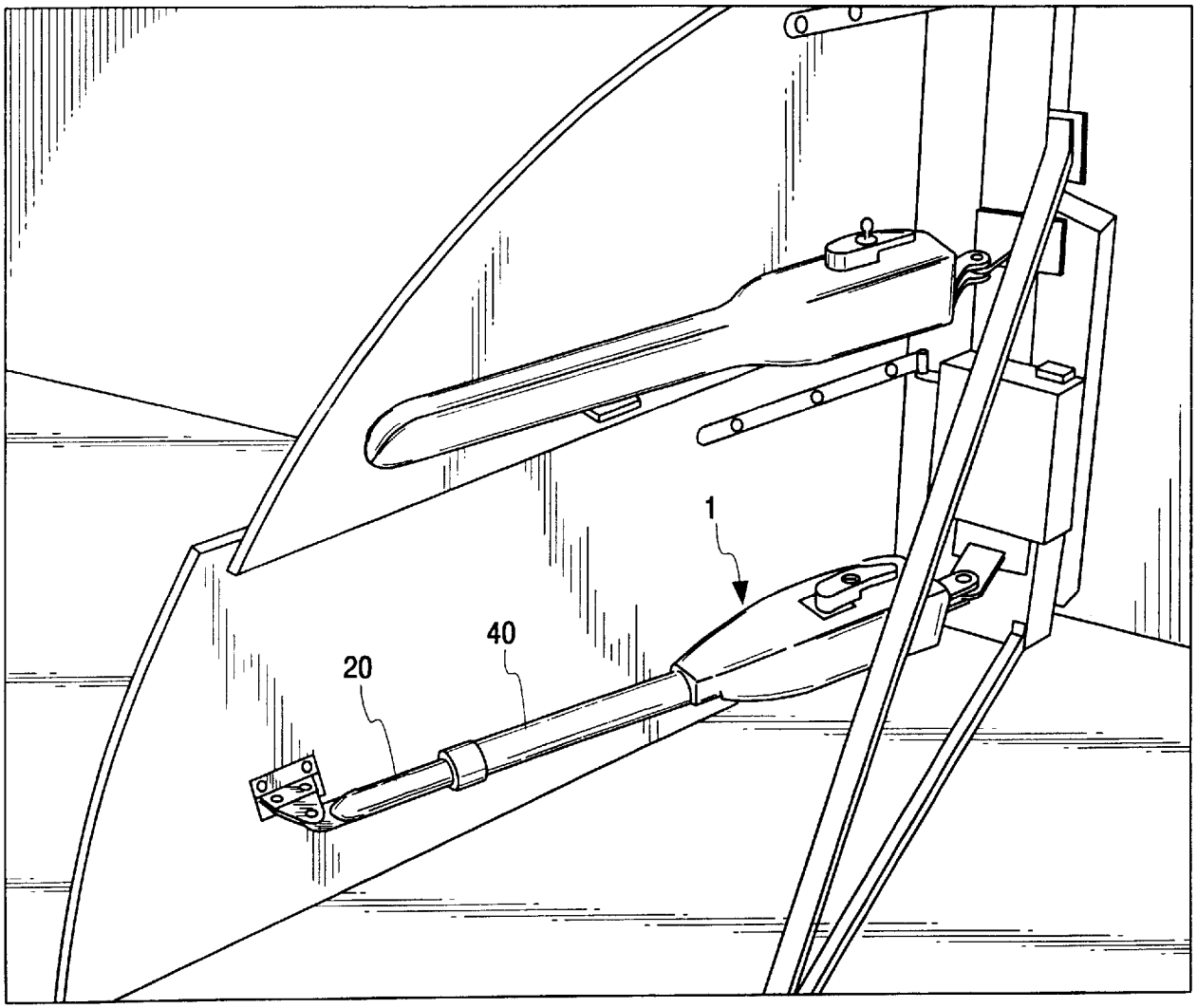
FIG. 21 is a perspective view of the operator assembly of FIG. 1 showing the arm in a retracted position.
Figure 22:
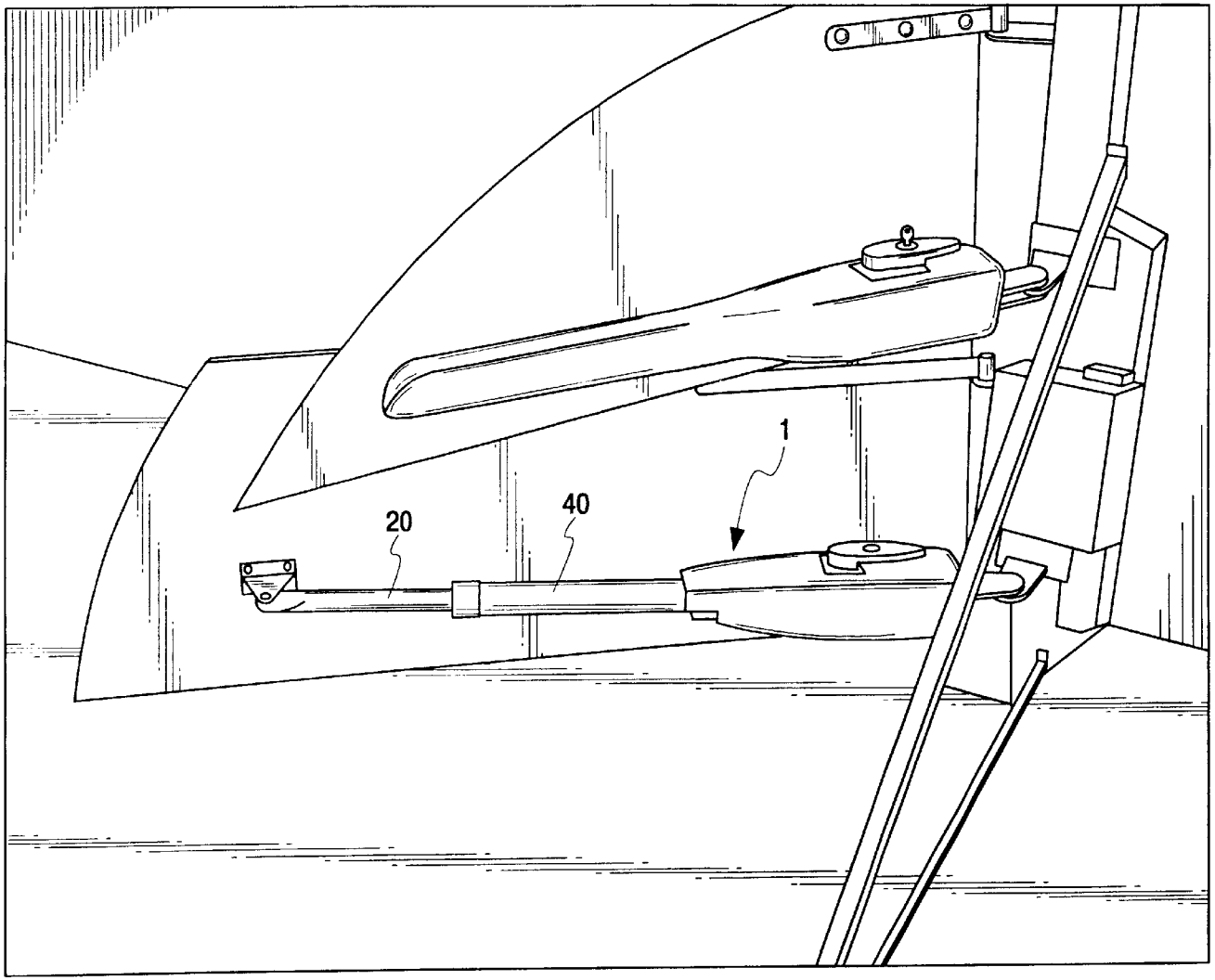
FIG. 22 is a perspective view of the operator assembly of FIG. 1.
Figure 23:
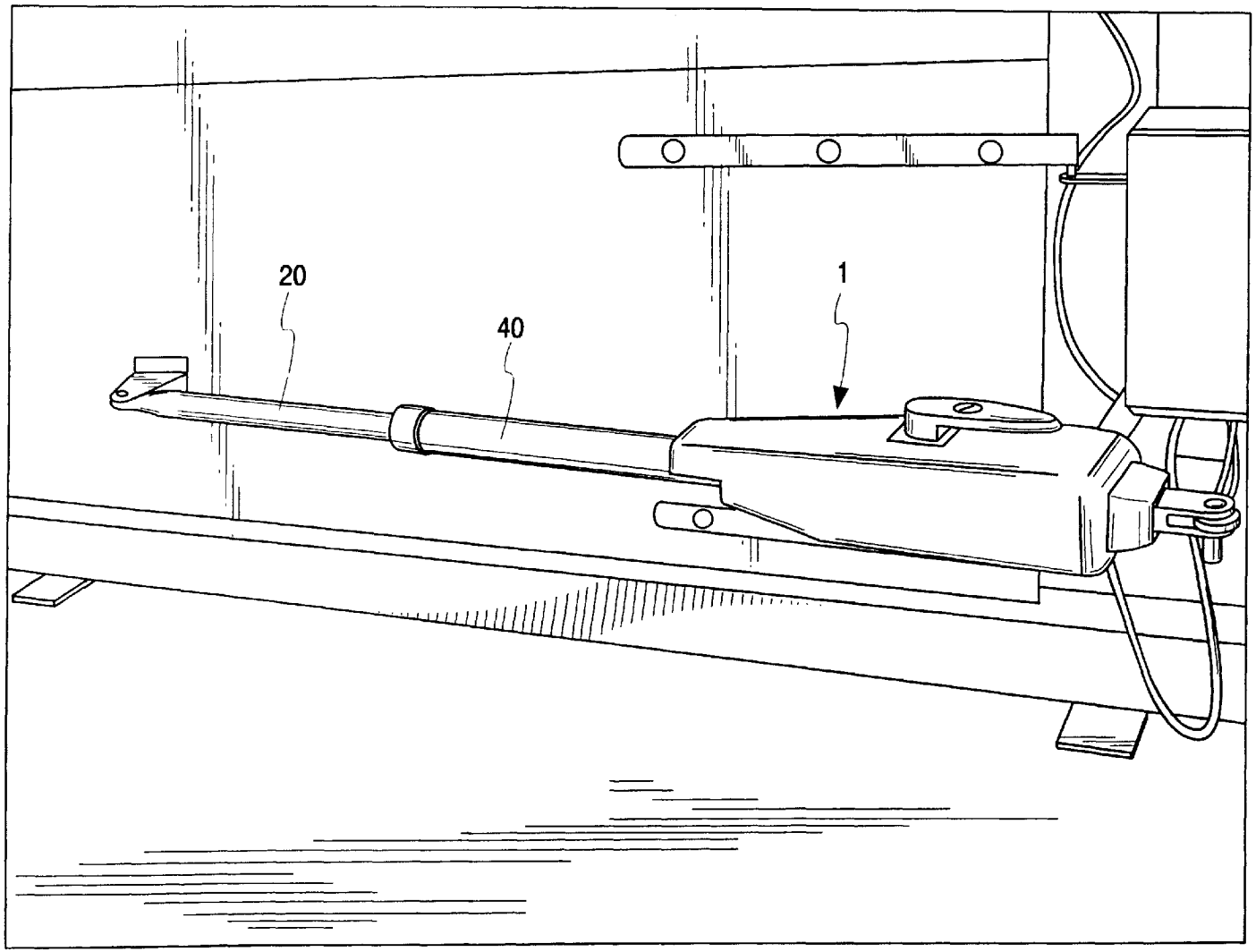
FIG. 23 is a perspective view of the operator assembly of FIG. 1 showing the arm in an extended position.
Figure 24:
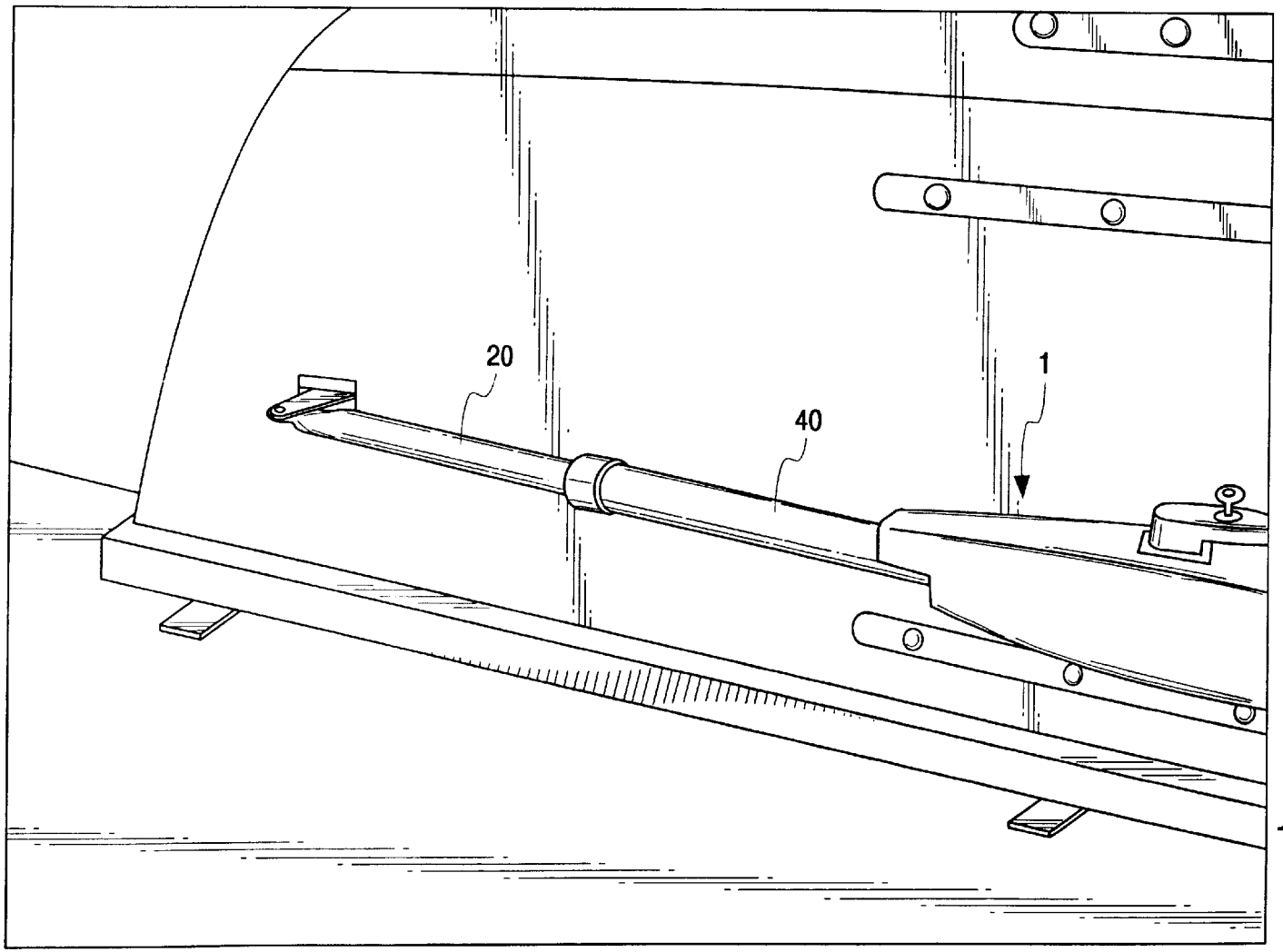
FIG. 24 is a perspective view of the operator assembly of FIG. 1 showing the arm in an extended position.
Figure 25:
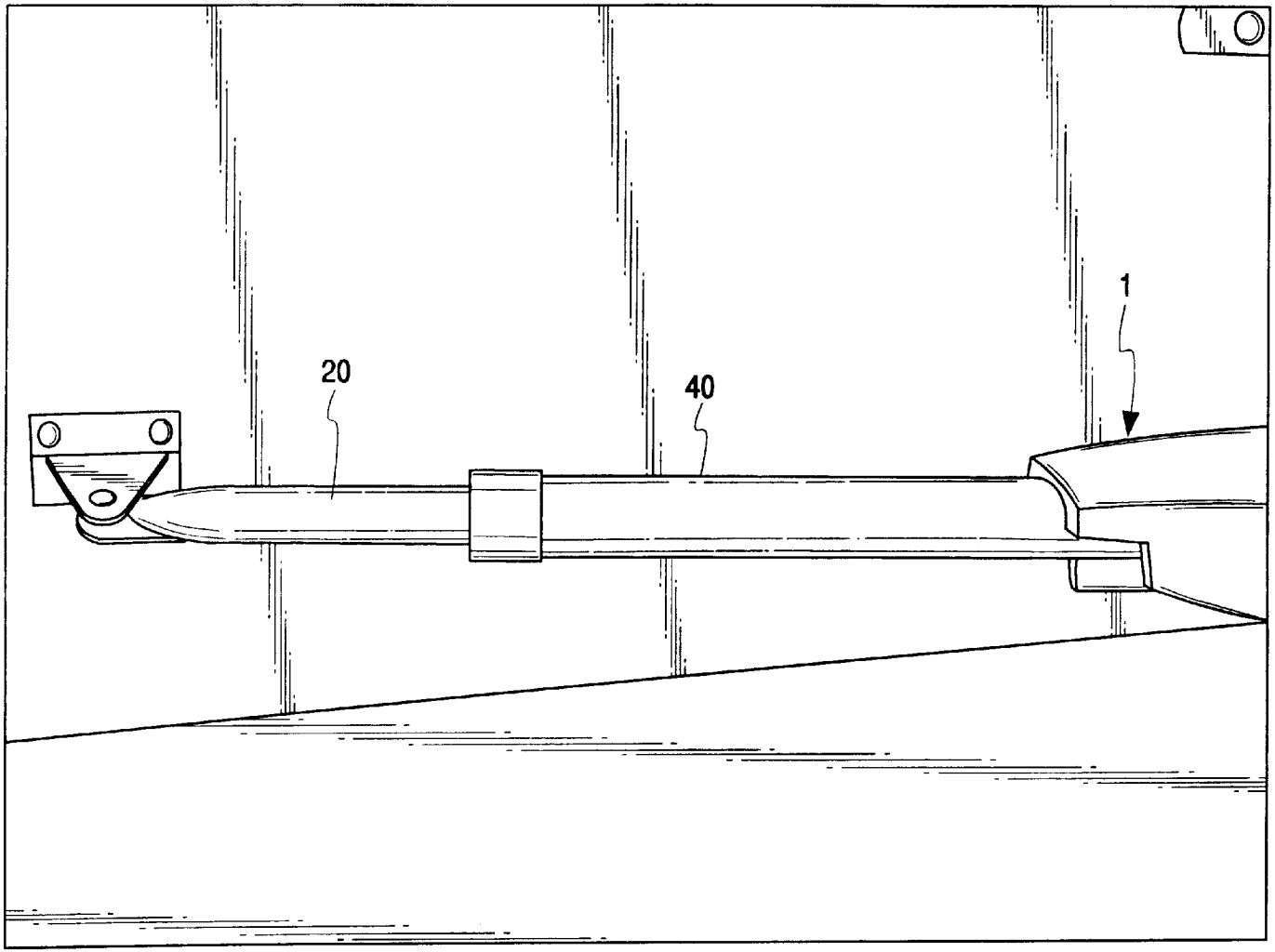
FIG. 25 is a perspective view of the operator assembly of FIG. 1.
Figure 26:
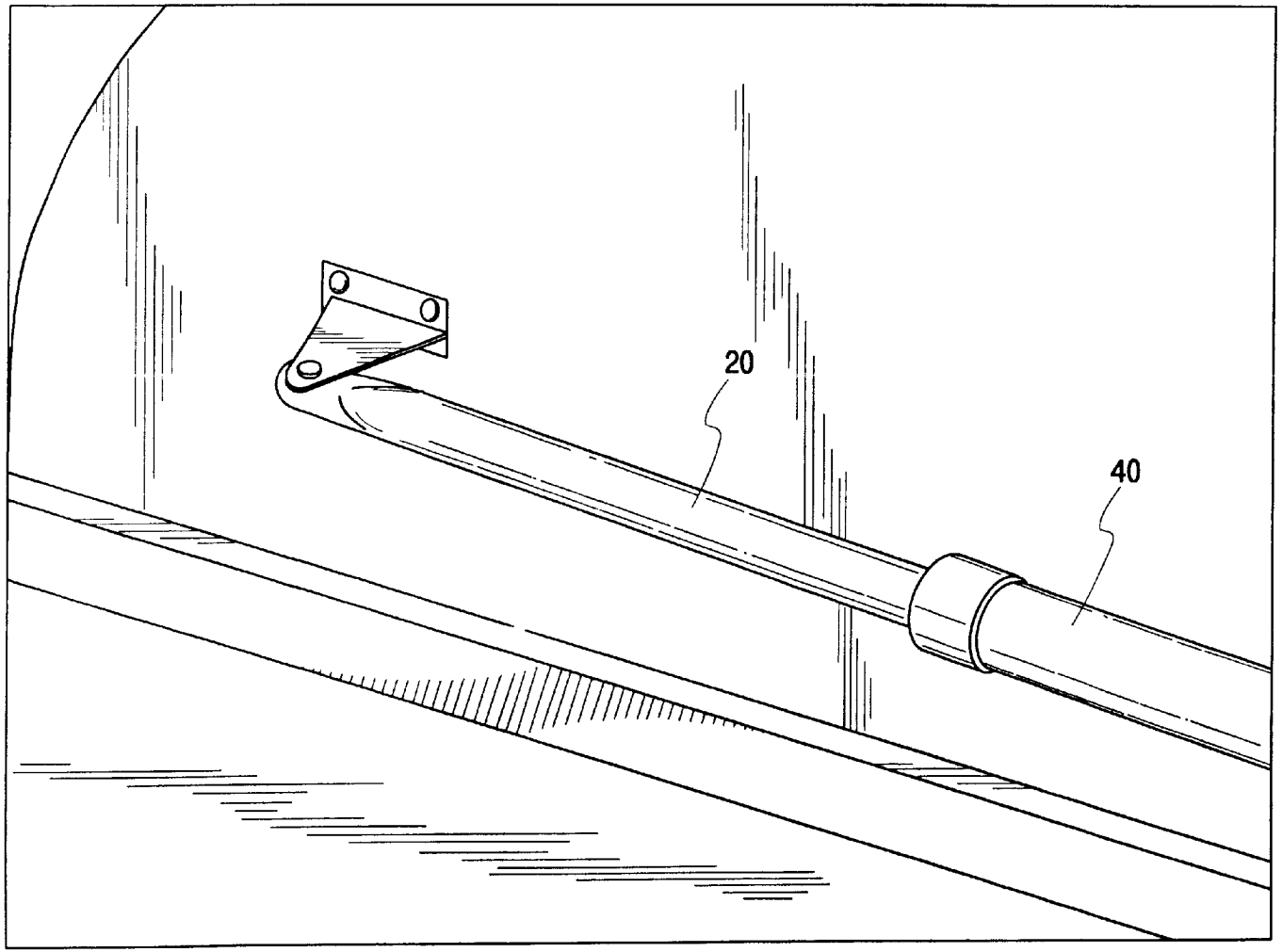
FIG. 26 is a perspective view of the operator assembly of FIG. 1.

As illustrated in FIG. 6, the actuator arm 22 comprises a cylindrical tube with an end, opposite an end proximate the motor 10, having a pivot connection 22 comprising a flattened region 24 with an aperture therethrough 26. A bushing or other friction reducing surface, such as a bronze or plastic bushing, may be provided for insertion through the aperture and around a pin 142. The aperture 26 is adapted to receive the pin 142 or other suitable member for pivotably connecting the arm 22 to the movable barrier, such as with a yoke 140 mounted relative to the barrier, as illustrated in FIG. 18. Forming the pivot connection 22 with a flattened region 24 minimizes the number of parts required for the actuator arm 22, such as if a separate pivot connection were attached to the end of the arm 22. Furthermore, the pivot connection 22 provides for simplified manufacture of the actuator arm 20. For example, the pivot connection 22 may be formed by flattening, crimping, or stamping a cylindrical tube, such as illustrated in FIG. 4, to create the flattened region 24, as illustrated in FIG. 5. The aperture 26 may be provided in the flattened region 24 after the flattening thereof. The aperture 26 may also be provided in the cylindrical tube prior to flattening thereof.

As illustrated in FIG. 2, the motor 10 and the transmission 50 are provided within a casing 150. The casing 150 may be formed of a plastic or polymer material, and can be shaped to add visual appeal to the operator apparatus 1, to protect the components from dirt, debris, or liquid, and/or to provide mounting surfaces for the various components thereof. As illustrated in FIG. 1, the casing 150 comprises at least two separate shells 152 and 154 that may be joined together to form the casing 150, such as by adhesive or friction joining.

The term barrier, as used herein, includes gates and other movable barriers. The barrier may include a single hinged gate, or dual hinged gates, each having an operator assembly 1 for shifting thereof. Other types of gate configurations and barriers are also contemplated by the invention, and the operator assembly or gate operator 1 of the invention may be used therewith.

From the foregoing, it will be appreciated that the invention provides an operator assembly and method for manufacturing an operator assembly. While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A gate operator for selectively opening and closing a gate, the gate operator comprising:

an arm having a first end pivotably connectable to the gate and a second end having a thread thereon;

a threaded screw for engaging the thread of the arm;

a motor having an output for rotating the threaded screw to extend or retract the arm relative to the motor, the motor output having a worm gear; and a transmission having one or more interchangeable gear sets, the transmission being positioned between the threaded screw and the motor for rotating the threaded screw via the motor output, each gear set having a different predetermined gear ratio to allow the same motor to be used with different gate sizes, the gear set having first and second shafts having longitudinal axes generally perpendicular to a longitudinal axis of the motor worm gear, the first shaft having a worm gear for engaging the motor output worm gear and an idler gear, the second shaft having an idler gear for engaging the first shaft idler gear and a worm gear for driving a gear attached to the threaded screw, the first shaft idler gear and the second shaft idler gear interchangeable effective to provide the predetermined gear ratio.

2. The gate operator of claim 1 wherein the first shaft idler gear and the second shaft idler gear have either of a 1:1 ratio or a 3:2 ratio.

3. A gate operator according to claim 1, wherein the first shaft idler gear is selectively disengageable relative to the first shaft worm gear effective to allow rotation of the first shaft worm gear independently of the first shaft idler gear to permit manual extension or retraction of the arm without operation of the threaded screw by the motor.

4. A gate operator according to claim 3, wherein the first shaft comprises an idler gear shaft having the idler gear mounted thereon and a worm gear shaft having the worm gear mounted thereon, the idler gear and worm gear shafts independently rotatable when biased apart with a spring, and dependently rotatable when the spring biasing force is overcome to enable the selective disengagement of the first shaft worm gear relative to the first shaft idler gear.

5. A gate operator according to claim 4, wherein the biasing force is overcome by a manually operable cam mechanism adapted to enable selective disengagement of the first shaft worm gear relative to the first shaft idler gear.

6. A gate operator for selectively opening and closing a gate, the gate operator comprising:

an arm having a first end pivotably connectable to the gate and a second end having a thread thereon, wherein the arm has a substantially hollow region at the second end thereof with at least one aperture therethrough, the aperture allowing the molding of an internal portion of the thread on the inside of the hollow region and an external portion of the thread on the outside of the hollow region, the internal and external portions of the thread being mechanically joined through the aperture effective to prevent removal of the thread from the second end of the arm;

a threaded screw for engaging the thread of the arm;

a motor having an output for rotating the threaded screw to extend or retract the arm relative to the motor; and a transmission having one or more interchangeable gear sets, the transmission being positioned between the threaded screw and the motor for rotating the threaded screw via the motor output, each gear set having a different predetermined gear ratio to allow the same motor to be used with different gate sizes.

7. A gate operator according to claim 6, wherein the arm is at least partially slidable within a hollow sleeve, the hollow sleeve having an end proximate the first end of the arm with a stop member molded thereto, the stop member effective to limit extension of the arm relative to the sleeve.

8. A gate operator according to claim 7, wherein the sleeve end has at least one aperture therethrough allowing the molding of an internal portion of the stop member on the inside of the sleeve end and an external portion of the stop member on the outside of the sleeve end, the internal and external portions of the stop member being mechanically joined through the aperture effective to prevent removal of the stop member from the sleeve end.

9. A gate operator adapted for either manual or automated operation, the gate operator comprising:

an arm having a first end pivotably connectable to a gate and a second end opposite the first end having a thread thereon, the arm being at least partially slidable within a hollow sleeve, the hollow sleeve having an end proximate the first end of the arm with a stop member molded thereto, the stop member being effective to limit extension of the arm relative to the sleeve;

a threaded screw for engaging the thread of the arm;

a motor having an output for rotating the threaded screw to extend or retract the arm relative to the motor; and a gear set positioned in a driving arrangement between the motor output and the threaded screw for driving the threaded screw with the motor output, the gear set disengageable from the driving arrangement effective to allow extension or retraction of the arm without operation of the threaded screw by the motor.

10. A gate operator according to claim 9, wherein the sleeve end has at least one aperture therethrough allowing the molding of an internal portion of the stop member on the inside of the sleeve end and an external portion of the stop member on the outside of the sleeve end, the internal and external portions of the stop member being mechanically joined through the aperture effective to prevent removal of the stop member from the sleeve end.

11. A gate operator adapted for either manual or automated operation, the gate operator comprising:

an arm having a first end pivotably connectable to a gate and a second end opposite the first end having a thread thereon, the first end of the arm being substantially hollow and having a crimped end portion with an aperture therethrough, the aperture being effective to allow pivotable attachment of the arm relative to the gate;

a threaded screw for engaging the thread of the arm;

a motor having an output for rotating the threaded screw to extend or retract the arm relative to the motor; and a gear set positioned in a driving arrangement between the motor output and the threaded screw for driving the threaded screw with the motor output, the gear set disengageable from the driving arrangement effective to allow extension or retraction of the arm without operation of the threaded screw by the motor.

12. A gate operator according to claim 11, wherein the crimped end portion of the first end of the arm is pivotably attached to a yoke fixed relative to the gate.

13. A gate operator according to claim 11, wherein the aperture of the crimped end portion of the arm is offset from the longitudinal axis of the arm.

14. An operator assembly for opening and closing a movable barrier, the operator assembly comprising:

a motor having a predetermined power rating and an output shaft;

an actuator having a drive shaft driven by the motor for shifting the movable barrier with a predetermined output force between open and closed positions thereof; and an adjustable transmission between the motor and the actuator that allows the predetermined output force provided by the actuator to be selected, the transmission being configured so that the shafts are aligned with each other to maximize barrier configurations in which the operator can be used, the transmission including a pair of intermediate shafts oriented normal to the aligned shafts and having gears that transmit rotation of the motor output shaft to the actuator drive shaft aligned therewith for in-line driving thereof allowing the operator to be mounted on either side of the barrier.

15. A gate operator for selectively opening and closing a gate, the gate operator comprising:

an arm having a first end pivotably connectable to the gate and a second end having a thread thereon, the first end of the arm being substantially hollow and having a crimped end portion with an aperture therethrough, the aperture being effective to allow pivotable attachment of the arm relative to the gate;

a threaded screw for engaging the thread of the arm;

a motor having an output for rotating the threaded screw to extend or retract the arm relative to the motor; and a transmission having one or more interchangeable gear sets, the transmission being positioned between the threaded screw and the motor for rotating the threaded screw via the motor output, each gear set having a different predetermined gear ratio to allow the same motor to be used with different gate sizes.

16. A gate operator according to claim 15, wherein the crimped end portion of the first end of the arm is pivotably attached to a yoke fixed relative to the gate.

17. A gate operator according to claim 15, wherein the aperture of the crimped end portion of the arm is offset from the longitudinal axis of the arm.

18. A gate operator adapted for either manual or automated operation, the gate operator comprising:

an arm having a first end pivotably connectable to a gate and a second end opposite the first end having a thread thereon;

a threaded screw for engaging the thread of the arm;

a motor having an output with a worm gear for rotating the threaded screw to extend or retract the arm relative to the motor; and a gear set positioned in a driving arrangement between the motor output and the threaded screw for driving the threaded screw with the motor output, the gear set disengageable from the driving arrangement effective to allow extension or retraction of the arm without operation of the threaded screw by the motor, the gear set having first and second shafts with longitudinal axes generally perpendicular to a longitudinal axis of the worm gear, the first shaft having a worm gear for engaging the motor output worm gear and an idler gear, the second shaft having an idler gear for engaging the first shaft idler gear and a worm gear for driving a gear attached to the threaded screw, and the first shaft idler gear being selectively disengageable relative to the first shaft worm gear such that the first shaft worm gear can rotate independently of the first shaft idler gear.

19. A gate operator according to claim 18, wherein the first shaft comprises an idler gear shaft having the idler gear mounted thereon and a worm gear shaft having the worm gear mounted thereon, the idler gear and worm gear shafts independently rotatable when biased apart with a spring, and dependently rotatable when the spring biasing force is overcome to enable the selective disengagement of the first shaft worm gear relative to the first shaft idler gear.

20. A gate operator according to claim 19, wherein the biasing force is overcome by a manually operable cam mechanism adapted to enable selective disengagement of the first shaft worm gear relative to the first shaft idler gear.

21. An operator assembly for shifting a movable barrier between open and closed positions, the operator assembly comprising:

a motor;

an actuator assembly driven by the motor to shift the barrier between the open and closed positions;

a drive screw driven for rotation by the motor and having threads;

a driven elongate member of the actuator assembly having spaced ends with one end pivotably connectable relative to the barrier and the other end engaged with the drive screw;

fixed integral threads of the driven member on the other end thereof, the threads of the driven member configured to be drivingly engaged by the drive screw threads for shifting the driven member between an extended position with the gate in one of the open and closed positions and a retracted position with the gate in the other of the open and closed positions; and the driven member having a tubular wall having interior and exterior surfaces and apertures formed at the other end thereof, and the integral threads are of plastic material molded in-situ at the other end of the tubular wall so that plastic material extends through the apertures onto both the interior and exterior surfaces to mechanically lock the plastic onto the tubular wall.

22. An operator assembly for shifting a movable barrier between open and closed positions, the operator assembly comprising:

a motor;

an actuator assembly driven by the motor to shift the barrier between the open and closed positions;

a drive screw driven for rotation by the motor and having threads;

a driven elongate member of the actuator assembly having spaced ends with one end pivotably connectable relative to the barrier and the other end engaged with the drive screw;

fixed integral threads of the driven member on the other end thereof, the threads of the driven member configured to be drivingly engaged by the drive screw threads for shifting the driven member between an extended position with the gate in one of the open and closed positions and a retracted position with the gate in the other of the open and closed positions;

the actuator assembly having a housing with a generally cylindrical wall for the driven member and an integral guide element fixed to the housing wall for sliding engagement with the driven member during extension and retraction thereof; and the housing wall having apertures at a forward end thereof, and the guide element is of a plastic material molded in-situ at the wall forward end so that material extends through the wall apertures mechanically locking the guide element to the wall.

* * * * *